United States Patent [19]

Smolens

[11] 3,951,594

[45] Apr. 20, 1976

[54] HYDROGEN PEROXIDE BLEACHING SOLUTIONS AND PROCESS

[75] Inventor: Harry Gregory Smolens, Philadelphia, Pa.

[73] Assignee: Pennwalt Corporation, Philadelphia, Pa.

[22] Filed: Mar. 25, 1975

[21] Appl. No.: 561,753

Related U.S. Application Data

[63] Continuation of Ser. No. 309,852, Nov. 27, 1972, abandoned.

[52] U.S. Cl. ..... 8/111; 252/186; 252/99; 252/97; 252/95; 252/135; 252/157

[51] Int. Cl.[2] ..... D06L 3/02; C11D 7/56

[58] Field of Search ..... 8/111; 252/99, 97, 95, 252/135, 157, 186; 423/272, 273, 544

[56] References Cited

UNITED STATES PATENTS

| | | | |
|---|---|---|---|
| 2,820,690 | 1/1958 | Feldmann | 252/186 |
| 3,003,910 | 10/1961 | Dithmar | 8/111 |
| 3,640,885 | 2/1972 | Rhees | 252/186 |
| 3,687,627 | 8/1972 | Stalter | 252/186 |
| 3,740,187 | 6/1973 | Kowalski | 252/186 |

*Primary Examiner*—Donald Levy
*Assistant Examiner*—Maria S. Tungol
*Attorney, Agent, or Firm*—Robert G. Danehower

[57] ABSTRACT

Textile fabrics have been bleached with aqueous solutions of hydrogen peroxide for many years. Since hydrogen peroxide is quite unstable under bleaching conditions, stabilizers have been necessary and silicate of soda, commonly called water glass, is the stabilizer commonly used in the industry. Water glass has a number of disadvantages when used in commercial bleaching of textiles. This invention provides new processes for bleaching textile fabrics with aqueous solutions of hydrogen peroxide containing sodium orthosilicate in combination with a magnesium ion-polyphosphate ion stabilizer and new compositions of matter comprising aqueous solutions of hydrogen peroxide containing an effective amount of sodium orthosilicate and magnesium-polyphosphate stabilizer.

6 Claims, No Drawings

HYDROGEN PEROXIDE BLEACHING SOLUTIONS AND PROCESS

This is a continuation of application Ser. No. 309,852, filed Nov. 27, 1972, now abandoned.

BACKGROUND OF THE INVENTION

Fabrics as they come from the loom or the knitting machine in their unfinished state are referred to as greige or grey goods. They may contain warp sizing, trash, oils and off-color impurifications called motes. Before they are ready for the customer the fabrics are desized, scoured, bleached, dyed and finished. Approximately eighty per cent of all cotton fabrics are bleached with hydrogen peroxide.

Hydrogen peroxide bleaching solutions are normally quite unstable as they are decomposed by the action of sunlight, metallic impurities and organic matter. To prevent excessive decomposition of hydrogen peroxide it is stored and shipped in glass, aluminum or stainless steel. In the bleaching process for textile fabrics using hydrogen peroxide as the bleaching agent, an alkali such as sodium hydroxide or soda ash is often used along with a stabilizer which throughout the years has been silicate of soda sold as water glass.

The use of water glass as a stabilizer for hydrogen peroxide solutions has presented objectionable processing problems which have been endured by the textile industry. Water glass creates a serious scaling problem on the bleaching equipment which interferes with the flow of the fabric through the bleaching process. Where hard water is encountered the scaling often clogs feed tanks and pipe lines which requires that the equipment be shut down for cleaning. Splashes and spills on the floor leave a heavy white crust which is difficult to remove and creates a walking hazard to the employees.

The water glass is also objectionable with respect to the cloth being bleached. When silicate solids deposit on the goods, a harsh handle or feel results and the absorbency of the goods will be substantially lower in those places where deposits have occurred. This causes serious difficulties in dyeing operations as uneven dyeing takes place.

BRIEF DESCRIPTION OF THE INVENTION

I have now discovered that sodium orthosilicate is a superior alkali for hydrogen peroxide bleaching solutions. In one aspect of my invention textile fabrics, especially cottons and mixtures of cottons and polyesters are bleached with aqueous hydrogen peroxide solutions containing an effective amount of sodium orthosilicate in combination with a stabilizer which provides a stabilizing amount of magnesium ion and alkali metal polyphosphate. The use of sodium orthosilicate overcomes the many difficulties encountered in using the prior art silicate of soda. An effective amount of the sodium orthosilicate is required in the aqueous hydrogen peroxide solution which is at least 1.5 grams per liter. Useful concentrations of sodium orthosilicate in these solutions will be between 1.5 and 7.5 grams per liter.

In addition to the sodium orthosilicate, an effective amount of magnesium-alkali metal polyphosphate stabilizer is required in my peroxide bleaching solutions and bleaching processes. The manner of use and concentrations is described in U.S. Pat. No. 2,838,459.

The magnesium ion concentration will be within the range of 0.03 to 2 grams per liter of magnesium and from 0.03 to 10 grams per liter of alkali metal polyphosphate.

In all other respects the hydrogen peroxide bleaching solutions of my invention and the manner of applying them to textile fabrics follows the conditions which have been employed in the industry for many years.

DETAILED DESCRIPTION OF INVENTION

Woven or knit fabrics as they come from the loom or knitting machine are known as grey goods and usually will contain trash, oils, sizing and off-color motes. Before the grey goods are ready for sale they are desized, scoured, bleached, dyed and finished. Bleaching is usually required for proper dyeing and finishing or for whiteness.

Aqueous hydrogen peroxide is used by the textile industry for bleaching because it is efficient, easy to handle and inexpensive. As hydrogen peroxide comes to the mill from the supplier it is usually acidic. In this condition it is of very little value for bleaching. It must be made alkaline to be effective. Caustic soda is most commonly used with soda ash being used for some particular applications. Although effective as a bleach activator, caustic and other strong alkalies cannot be used alone because they cause the hydrogen peroxide to decompose before the necessary bleaching takes place. To compensate for this a stabilizer has to be used. Liquid silicate of soda, or water glass as it is also known, is the standard stabilizer for the industry. Textile grade water glass is 42° Be′ which has a density of 1.408. This water glass contains 10.5% $Na_2O$ and 26.3% silica ($SiO_2$) for a ratio of 1 $Na_2O$ to 2.5 $SiO_2$. The solids content is 36.8% with the remainder being water.

Additional ingredients may be added to the bleach formula which varies widely from plant to plant and from one type of fabric to another. These include phosphates, sequestrants, fluorescent whitening agents and surfactants. A washing operation follows the bleaching to remove the remaining traces of the bleach ingredients.

The cloth is now ready for finishing if it is to remain white or for dyeing if it is to be colored. Finishing includes pre-shrinking, mercerization, or treatment with anti-stat, flame retardant, durable press and soil release chemical agents.

Sodium silicate or water glass in the aqueous peroxide solutions has the following disadvantages. It forms complex salts with calcium and magnesium which coat the surfaces of the bleaching equipment and surrounding areas with a hard to remove film. These coatings on the equipment cause uneven flow of fabric through the processing equipment. The complex silicate salts which are not washed out of the fabrics resist subsequent dyeing. The high sodium silicate concentration which is about 12 grams/liter in peroxide bleaching solutions is difficult to rinse and the silicate remains on the fabric particularly at folds and gives it a harsh hand or feel, and additionally, may reduce the elasticity of knit fabrics. Since only about one third of sodium orthosilicate is required to replace the entire water glass in the peroxide solutions used today, the disadvantages described above are avoided.

The new bleaching solutions of my invention comprise aqueous solutions of hydrogen peroxide containing an effective amount of sodium orthosilicate. The hydrogen peroxide concentration will generally be within the range of 3 to 15 grams per liter (100% basis). The hydrogen peroxide is supplied commercially to the textile mills as 50 per cent by weight peroxide.

The effective amount of sodium orthosilicate is a concentration of at least 1.5 grams per liter. A useful range of sodium orthosilicate is 1.5 to 7.5 grams per liter. Sodium orthosilicate is a granular material containing 67.4% wt. $Na_2O$ and 32.6% wt. $SiO_2$. The ratio of $Na_2O$ to $SiO_2$ is 2 to 1. Sodium orthosilicate is available from Pennwalt Corporation under the trademark Penolox.

The alkalinity and pH of the peroxide bleaching solution are adjusted by varying the amount of sodium orthosilicate used within the range of 1.5 to 7.5 grams per liter. The pH follows the amount of orthosilicate used and will generally be within the range of 10 to 11.5.

The bleaching solutions of my invention use the magnesium-polyphosphate stabilizer for peroxide solutions as disclosed in U.S. Pat. No. 2,838,459 and this teaching is incorporated by reference. My peroxide solutions require from 0.03 to 2 grams of magnesium ion per liter and from 1 to 5 times as much alkali metal polyphosphate (as disclosed in the above patent). Suitable sources of magnesium ion are one or more of the anhydrous and hydrated magnesium sulfate, magnesium chloride, magnesium nitrate and magnesium acetate. The polyphosphate may be supplied by one or more of the alkaline salts selected from the group consisting of sodium hydroxide, potassium hydroxide, sodium carbonate, sodium bicarbonate, the alkali metal polyphosphates such as sodium tetraphosphate, sodium pyrophosphate, sodium tripolyphosphate, sodium hexametaphosphate or the equivalent potassium polyphosphates, sodium orthophosphate, sodium silicate and sodium metaphosphate.

In deciding on a particular peroxide bleaching formulation, the hydrogen peroxide concentration and the sodium orthosilicate concentration will be varied within the limits described above until a satisfactory whitening of the cloth is obtained. The least amount of magnesium-polyphosphate stabilizer is used consistent with a reasonable amount of peroxide decomposition.

In addition to the stabilizer and alkali which are necessary for efficient bleaching with aqueous peroxide solutions, there may be present other chemical additives such as chelating agents, sequestrants, surfactants, optical whiteners and/or other agents.

The cotton or cotton-polyester gray goods are desized, rinsed in water to remove the desizing solution, and then moved into or through the scouring operation. Scouring is accomplished by the use of strong caustic soda solutions at high temperatures. Scouring removes trash, softens motes and emulsifies oils and greases. After scouring, the fabrics are rinsed again with water and are then passed into the bleaching steps.

Bleaching, as well as the other fabric treating steps, may be done batch-wise or continuously. Continuous bleaching is processed in either rope or open-width forms. In the rope form, the fabric is twisted like a rope as it moves through the processing steps. Open-width processing means that the cloth passes along open and under tension. Most fabrics to be dyed are handled open-width.

The cloth to be bleached is passed into or through a saturator where the bleaching solution is picked up by the fabric. The bleaching solution may be supplied from a head tank where the bleaching solutions are prepared. The cloth is in contact with the bleaching solution in the saturator from one to about five seconds in open-width processing and from one or two minutes when in rope form. The temperature in the saturator will normally be at room temperature.

In continuous bleaching hydrogen peroxide solution requires a high temperature and sufficient contact time with the cloth to achieve effective bleaching. This is accomplished in the peroxide steamer. The temperature may vary from 160°F to boiling at 212°F. The lower temperatures are preferred for polyester blends while higher temperatures are preferred for cotton goods. The cloth hold-up in the steamer may vary from 5 minutes to 2 hours. The steamer is usually a J box in continuous bleaching. In batch bleaching kiers or becks are usually used. Temperatures vary from 160° to about 190°F. Bleaching time will vary from 2 to 5 hours. After bleaching, the fabric is rinsed again with water and then it moves on to the dyeing and finishing operations.

The best mode of practicing my invention will be apparent from a consideration of the following examples:

EXAMPLE 1.

Cotton terrycloth toweling was scoured in rope form and then bleached for about 1 hour at a temperature of about 190°F in a J box in alkaline hydrogen peroxide solution. The saturator had the following concentration: hydrogen peroxide 6 grams per liter; sodium orthosilicate 1.6 grams per liter, magnesium ion 0.08 grams per liter supplied as magnesium sulfate heptahydrate and 0.36 grams per liter of sodium hexametaphosphate; a sequestrant — Dequest 2000 (methylphosphoric acid sodium salt) at 0.17 grams per liter. A satisfactory whiteness of the toweling was obtained with an 85% pick up of bleaching solution in the saturator. About 150,000 pounds of toweling were bleached in this manner.

EXAMPLE 2.

Bleaching of uncut scoured cotton corduroy was carried out in a 7-minute open width duPont J box. Concentrations in the saturator were as follows:

- hydrogen peroxide — 13 to 14 grams per liter (100%)
- sodium orthosilicate — 7.2 grams per liter
- magnesium ion — 0.08 grams per liter supplied as magnesium sulfate heptahydrate
- sodium hexametaphosphate — 0.36 grams per liter
- modified diethylene triamine pentaacetic acid chelate — 2.3 grams per liter About 78,000 yards of cloth were process in which the whiteness averaged approximately 85% on the Hunter D-40 reflectometer. This was a very good value for subsequent dyeing of the cloth.

EXAMPLE 3.

The bleaching efficiency of peroxide solutions using caustic soda with water glass stabilizer was compared with the bleaching composistions using sodium orthosilicate and magnesium-polyphosphate stabilizer on unbleached and scoured cotton terrycloth toweling. The cloth was immersed in the solutions described in Table 1 for 1 hour at 200°F. In all runs the water to fabric ratio was 5 to 1. The cloth was rinsed by hand, tumble-dried and the whiteness read on a Hunter D-40 reflectometer by noting the blue reflectance. The results show that equivalent whiteness was obtained by using only one-fourth the amount of alkali in the form of orthosilicate.

Table 1

| Hydrogen Peroxide Solutions - (Basis 1 liter) | 1 | 2 | 3 |
|---|---|---|---|
| Water glass (42° Be') ($Na_2O$ to $SiO_2$ 1 to 2.5) | 7.2 | — | — |
| Caustic soda (100%) | 1.2 | — | — |
| Trisodium phosphate. 12 hydrate | 1.2 | — | — |
| Sodium orthosilicate | — | 2.4 | 2.4 |
| Magnesium | — | 0.08 | 0.04 |
| Sodium hexametaphosphate | — | 0.36 | 0.18 |
| pH | 10.9 | 10.8 | 10.9 |
| Hydrogen peroxide (100%) | 3.3 | 3.3 | 3.3 |
| Average whiteness | 79.7 | 79.5 | 80.3 |

I claim:

1. The process of bleaching textile fabrics with hydrogen peroxide solution to insure uniform dyeing of the textile fabrics while preventing scaling of bleaching equipment consisting essentially of contacting the textile fabrics with an aqueous hydrogen peroxide solution containing an effective amount of sodium orthosilicate to control the alkalinity and pH of the peroxide solution.

2. The process of claim 1 in which the concentration of sodium orthosilicate is at least 1.5 grams per liter.

3. The process of claim 1 in which the concentration of sodium orthosilicate is within the range of about 1.5 to about 7.5 grams per liter.

4. The process of bleaching textile fabrics with hydrogen peroxide solution to insure uniform dyeing of the textile fabrics while preventing scaling of the bleaching equipment consisting essentially of contacting the textile fabrics with aqueous hydrogen peroxide solution containing at least 1.5 grams per liter of sodium orthosilicate to control alkalinity and pH of the peroxide solution and a stabilizing amount of magnesium-alkali metal polyphosphate stabilizer.

5. The process of claim 4 in which the concentration of sodium orthosilicate is at least 1.5 grams per liter and the concentration of magnesium ion and alkali metal polyphosphate is at least 0.03 grams per liter.

6. The aqueous solutions for bleaching textile fabrics consisting essentially of from 3 to 15 grams per liter of hydrogen peroxide, at least 1.5 grams per liter of sodium orthosilicate and a stabilizing amount of magnesium-alkali metal polyphosphate stabilizer.

* * * * *

UNITED STATES PATENT OFFICE

CERTIFICATE OF CORRECTION

Patent No. 3,951,594 Dated April 20, 1976

Inventor(s) Harry Gregory Smolens

It is certified that error appears in the above-identified patent and that said Letters Patent are hereby corrected as shown below:

Column 3, line 31, delete -- sodium hydroxide, potassium hydroxide, sodium carbonate,--

Column 3, line 32, delete -- sodium bicarbonate --

Column 3, line 36, delete --sodium silicate--

Signed and Sealed this

Second Day of November 1976

[SEAL]

*Attest:*

RUTH C. MASON
*Attesting Officer*

C. MARSHALL DANN
*Commissioner of Patents and Trademarks*